US005719994A

United States Patent [19]

Bouraoui

[11] Patent Number: 5,719,994

[45] Date of Patent: Feb. 17, 1998

[54] DETERMINATION OF AN EXCITATION VECTOR IN CELP ENCODER

[75] Inventor: Mustapha Bouraoui, Grenoble, France

[73] Assignee: SGS-Thomson Microelectronics S.A., Saint Genis, France

[21] Appl. No.: 621,084

[22] Filed: Mar. 22, 1996

[30] Foreign Application Priority Data

Mar. 24, 1995 [FR] France ..... 95 03735

[51] Int. Cl.[6] ..... G10L 3/02

[52] U.S. Cl. ..... 395/2.32; 395/2.28; 395/2.29; 395/2.71; 395/2.73

[58] Field of Search ..... 395/2.28, 2.29, 395/2.3, 2.32, 2.71, 2.73

[56] References Cited

U.S. PATENT DOCUMENTS 5,138,661 8/1992 Zinser et al. ..... 395/2.28

*Primary Examiner*—Allen R. MacDonald

*Assistant Examiner*—Alphonso A. Collins

*Attorney, Agent, or Firm*—Wolf, Greenfield & Sacks, P.C.; James H. Morris

[57] ABSTRACT

The present invention relates to a method for determining an excitation vector in a CELP speech signal encoder, said vector belonging to a subset associated with a larger set of excitation vectors likely to maximize a criterion. The method includes the steps of preselecting an excitation vector having as components those with the same sign as corresponding samples of a target vector and, if the preselected excitation vector does not belong to said subset, selecting as an excitation vector the vector which maximizes said criterion among the vectors of the subset which are respectively associated with the preselected vector and with the vectors closest to it in the larger set.

20 Claims, 2 Drawing Sheets

DETERMINATION OF AN EXCITATION VECTOR IN CELP ENCODER

BACKGROUND OF THE INVENTION

1. Field of the Invention

The present invention relates to the compression of speech signals to be transmitted on a telephone line, and more specifically to the determination of an excitation vector in performing a compression according to the Code-Excited Linear Prediction (CELP) method.

2. Discussion of the Related Art

FIG. 1 very schematically shows a CELP compression circuit. Such a circuit is based on a modeling of the vocal chords and of the resonance chamber constituted by the mouth, throat and larynx cavities. Such a compression method is thus optimized for speech signal processing.

The mouth, throat and larynx cavities are modeled by a "lie prediction" filter 10, the transfer function of which generally includes ten poles. The vocal chords are modeled by an excitation E processed by a comb filter 12.

A digitized speech signal S is analyzed frame by frame by an analysis circuit 14. For each frame, analysis circuit 14 determines coefficients $a_1$ to $a_{10}$ of the transfer function of filter 10, the pitch p of the comb filter 12, and a gain G applied at 16 to excitation E at the input of filter 12.

Values $a_i$, P and G are computed for each frame to account for the variations of the mouth cavity, for the frequency spectrum of the vocal chords and for the sound amplitude, respectively. It is so attempted to obtain an output of filter 10 equal to signal S. Then, instead of transmitting the samples of signal S, coefficients $a_i$, p and G are transmitted so that a decoder which receives these coefficients restores the corresponding frames of signal S.

Of course, the decoder must also know which excitation E to use. Determining coefficients $a_i$, p and G is not a problem. However, the search procedure for the optimal excitation remains the heaviest in terms of computing charge, and it is always very helpful to simplify it, even at the cost of a substantial reduction of the quality of the compression.

At the beginning of CELP encoding, the excitation E used to be selected in a table 18 (called "codebook") containing several possible excitations which actually represented portions of white noise. In this case, a control circuit 20 scans table 18 until the difference e, formed at 22, between the current frame of signal S and the corresponding frame at the output of filter 10 is minimal. (Of course, instead of comparing signal S with the output of filter 10, it is also possible to compare excitation E with the frame of signal S submitted to the inverse processing of filters 10 and 12).

With this technique, besides coefficients $a_i$, p and G, the address C selecting the best excitation E in table 18 is provided to a decoder having an homologous table.

Each excitation contained in table 18 is a sequence of digital samples respectively corresponding to the samples of each of the frames of the signal to be compressed. For the compression to be of acceptable quality, it is necessary to store a relatively large number, about 1000, of excitation sequences.

In order to limit the complexity of the search procedure, it has been suggested that each sample of an excitation sequence can take only three values, that is, 0, 1 or −1 (ternary excitation sequence). It has been found that this did not perceptibly alter the quality of the compression.

FIG. 2 shows an example of an excitation sequence E which has been suggested to further reduce the complexity of the search. This excitation sequence is called a binary sequence. It includes several non-zero samples of values 1 and −1, wherein two non-zero samples, or pulses, are separated by a constant number of zero samples, here 3. Such an excitation sequence can be represented by a binary number (or excitation code) C, whose bits are associated with the pulses and correspond to the polarity of the pulses. By proceeding in this manner, the code C supplied by control circuit 20 directly corresponds to an excitation sequence; table 18 is eliminated. Moreover, the complexity is reduced because the samples to be taken into account are reduced to the pulses, the number of these pulses being, in the example of FIG. 2, four times lower than the total number of samples in a sequence. Moreover, the structure of filters 10 and 12 is simplified.

This technique slightly alters the quality of the compression, but this alteration is easily compensated by a processing for eliminating the effects of the regularity of the spacing between the non-zero samples.

An excitation vector C is associated with each code C, the components of vector C being the values 1 and −1 corresponding to bits 0 and 1 of code C. The words "vector" and "code" will be used in the following description.

In order to further reduce the number of trials necessary to minimize the error, it has been suggested to limit the number of possible excitation codes or vectors to a subset representative of a greater set. The paper entitled "A Comparison of some Algebraic Structures for CELP Coding of Speech" by J. P. Adoul and C. Lamblin in Proc. ICASSP, 1987, describes such a method. To create a representative subset of all N-bit codes C, the set of n-bit (n<N) values is formed, each of these values being completed by N-n error correction bits.

In order to find the best excitation vector C, it is generally searched to maximize a selection criterion defined by:

$$m=scal^2(T, C_i)/mod^2(FC_i)$$

where $C_i$ is the tried excitation vector; T is a target vector formed by samples of the analyzed frame of signal S subatitted to the inverse processing of filters 10 and 12, these samples being the samples corresponding to the values 1 and −1 of vector $C_i$; and F is the matrix representing the transfer function of filters 10 and 12, in which only the rows corresponding to the values 1 and −1 of vector $C_i$ have been kept. The notations scal(.,.) and mod(.,.) respectively designate the scalar product and the module.

The trial of all excitation vectors $C_i$ according to this criterion represents a great amount of computation to be performed between the arrivals of two frames of signal S.

It has been established that the denominator of criterion m is approximately constant, whatever the excitation vector $C_i$ may be. Thus, criterion m is approximately maximized by maximizing the numerator. This numerator is maximized when each component of excitation vector $C_i$ is that of the same sign as the corresponding sample of target vector T. In other words, an approximate optimum excitation code is readily obtained by taking as its bits the sign bits (or the complements thereof) of the samples of the target vector.

This solution cannot be applied in the case where the usable excitation codes are limited to a subset representative of a larger set obtained, for instance, by means of an error correcting code.

SUMMARY OF THE INVENTION

An object of the present invention is to provide a method for reducing the amount of computation necessary to maximize the above-mentioned criterion m in the case where the usable excitation codes belong to a subset representative of a larger set.

To achieve this object, the present invention provides a method for determining an excitation vector associated with a frame of a speech signal to compress, said vector belonging to a subset associated with a larger set of excitation vectors likely to maximize a criterion, and having as components values 1 and −1 corresponding to a sequence of excitation vectors of a linear prediction filter. The criterion is equal to the square of the ratio between, on the one hand, the scalar product of the excitation vector by a target vector formed by samples of the frame submitted to an inverse linear prediction filtering and, on the other hand, the module of the excitation vector submitted to a direct linear prediction filtering. The method includes the steps of preselecting an excitation vector having as components those with the same signs as the corresponding samples of the target vector, or those with the opposite signs and, if the preselected excitation vector does not belong to said subset, of selecting as an excitation vector the vector that maximizes said criterion among the subset vectors which are respectively associated with the preselected vector and with the vectors closest to it in the larger set.

According to an embodiment of the present invention, the excitation vectors are associated with excitation codes having bits corresponding to the signs of the components of the excitation vector, an excitation code subset associated to said vector subset being formed by binary values completed by error correcting bits, any excitation code being associated with a subset excitation code through an error correcting function. The method includes the steps of forming a group including a preselected code associated with the preselected vector and the codes closest to it, in that each of these closest codes differs from the preselected code by a single bit, of submitting the codes of this group to the error correcting function so as to obtain a group of corrected codes belonging to the subset, and of selecting as an excitation code, among the corrected codes, the code associated with the vector which maximizes said criterion.

According to an embodiment of the present invention, the error correcting bits are the bits of a Hamming correcting code.

These objects, features and advantages, as well as others, of the present invention will be discussed in detail in the following description of specific embodiments, taken in conjunction with the following drawings, but not limited by them.

DETAILED DESCRIPTION

In order to maximize the above-mentioned criterion m, it has been found that the denominator of this criterion, that is, the square of the module of vector $FC_i$, is approximately constant, whatever the excitation vector $C_i$ may be. This approximation is relatively good, since the module of vector $C_i$ is constant. Thus, to approximately maximize criterion m, it is sufficient to maximize a simplified criterion which is the scalar product of target vector T by excitation vector $C_i$. This scalar product reaches its maximum when each component (1 or −1) of vector $C_i$ has the same sign as the corresponding sample of target vector T. An approximate optimal excitation vector Copt is thus obtained from target vector T.

This method does not directly apply in the cases where the possible excitation codes belong to a subset representative of a greater set, for instance when this subset is formed from n-bit values to which N-n bits of an error correction code are added. Indeed, the excitation vector found is then very likely not to belong to the subset. In this case, it could be considered to bring the excitation vector found beck to an excitation code belonging to the subset by applying an error correcting function associated with the correcting code. The excitation code closest to the excitation vector is then found in the subset. This "error correcting" causes the modification of at least one bit of the excitation code, where this bit can in certain cases have a strong influence on the value of criterion m, in such a way that the final excitation code provides unsatisfactory results.

As an example, a Hamming correcting code, referred to as H(N, n, 3) is used hereafter, where 3 is the minimum Hamming distance separating two elements belonging to the representative subset. The Hamming distance between two values is defined as the number of bit to bit differences between these two values. With this solution, a subset of $2^n$ excitation vectors of N bits is created An aspect of the invention is to form a group of excitation codes including an initial code found in maximizing the simplified criterion m as well as all the other codes obtained from the initial code by modifying only one bit. As a consequence, by using a Hamming single bit correcting code (minimum Hamming distance 3), each of the excitation codes of the group is close to a distinct code from the usable subset. Next, the Hamming error correcting function is applied to each code in the group, which brings each code in the group back to the closest code in the subset. A group of "corrected" codes belonging to the subset is obtained, which "surrounds" the code initially found. Among the corrected codes, the code maximizing the complete m criterion by calculating its numerator and its denominator is retained as the approximate optimal code.

Figure 1:
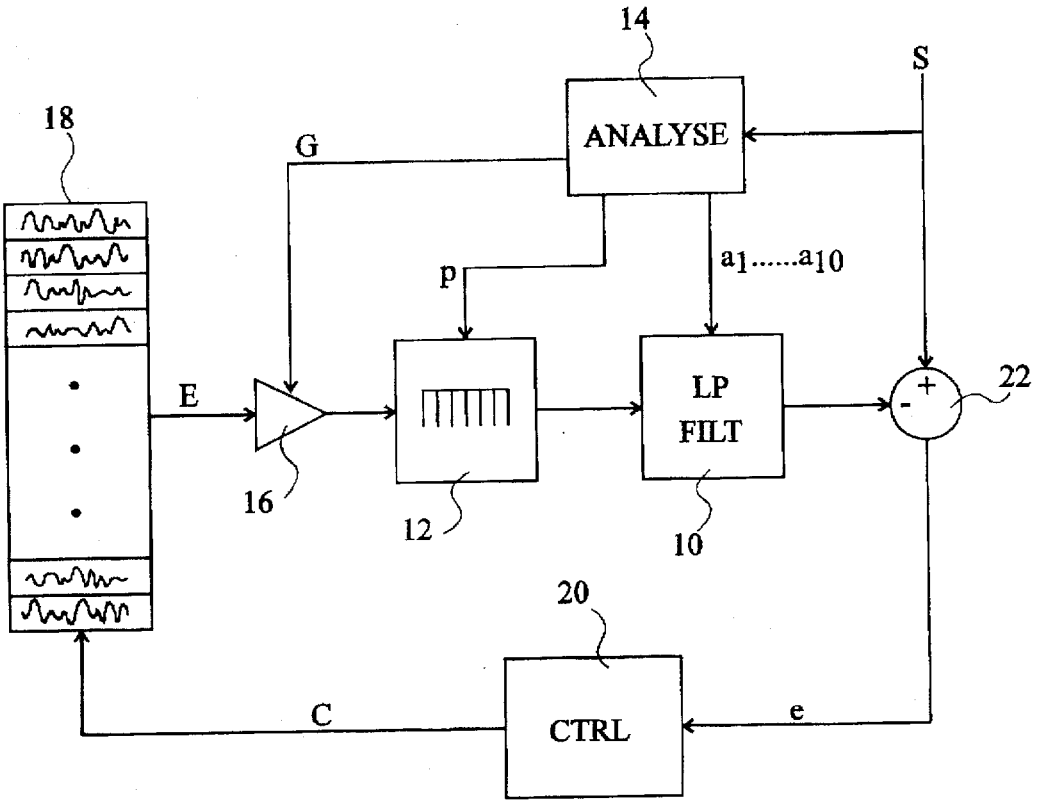
Fig 1 (Prior Art)
FIG. 1, previously described, illustrates a CELP compression method.
Figure 3:
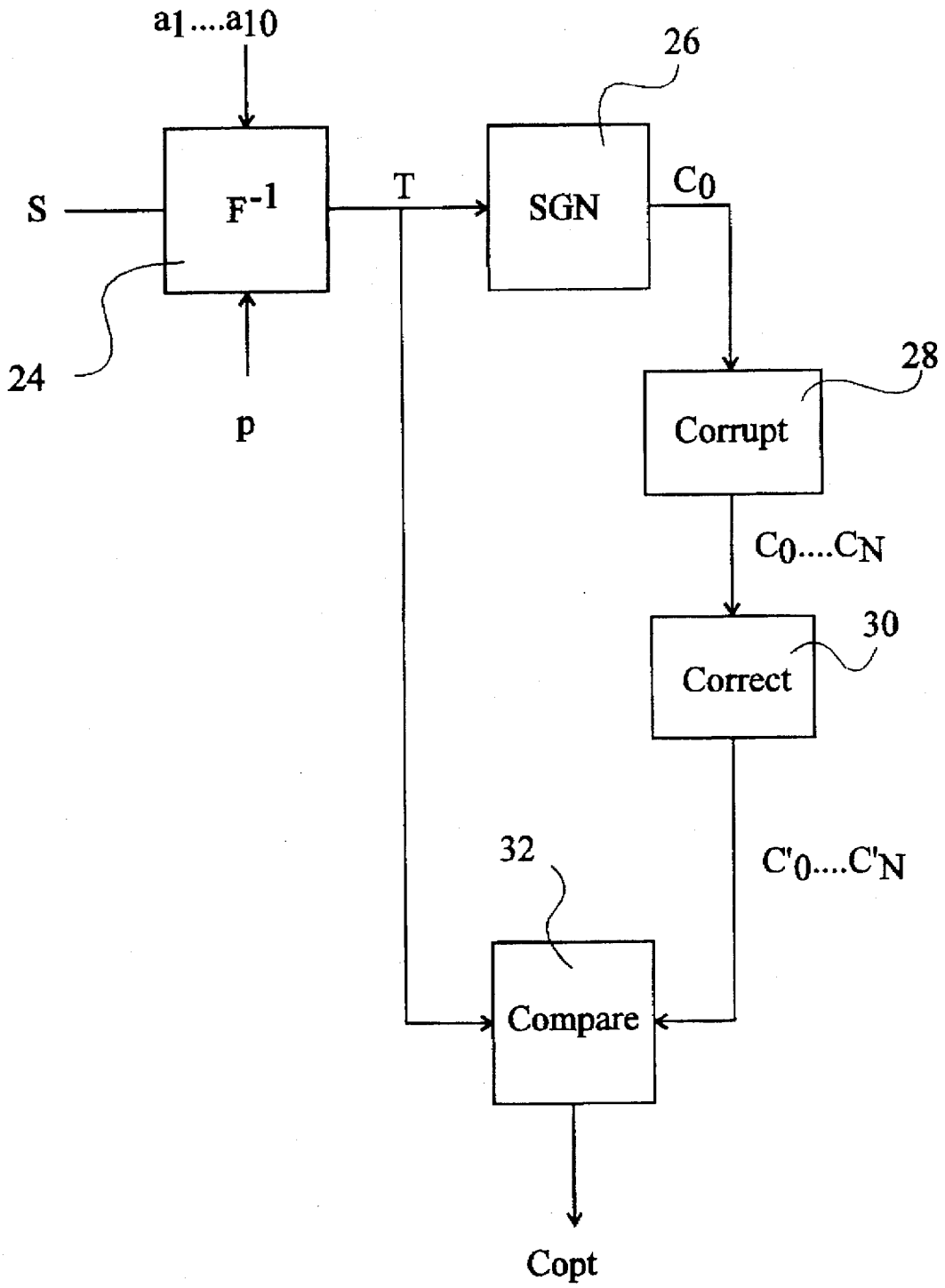
FIG. 3 illustrates steps to carry out according to the present invention in order to select an optimal excitation vector in the case where this excitation vector belongs to a subset obtained by using an error correcting code.

FIG. 3 schematically illustrates the method according to the invention which has just been described. The analyzed frame of signal S is submitted, at 24, to the inverse processing of filters 10 and 12 in FIG. 1. A target vector T is thus obtained. Only the samples of vector T corresponding to the pulses of the excitation sequence are kept. At 26, only the sign bits (or their complements) are retained from the samples of vector T to provide an initial excitation code $C_O$. This code $C_O$ is "corrupted" at 28 to fore a code group including code $C_O$ and all other codes $C_1$ to $C_N$ obtained by modifying a single bit of code $C_O$. Each code $C_O$ to $C_N$ undergoes at 30 an "error correction" to provide a group of corrected codes $C'_O$ to $C'_N$. At 32, each of the vectors associated to the corrected codes is compared to target vector T, and the code associated with the vector which maximizes the complete criterion m is retained as the approximate optimum excitation vector Copt.

Figure 2:
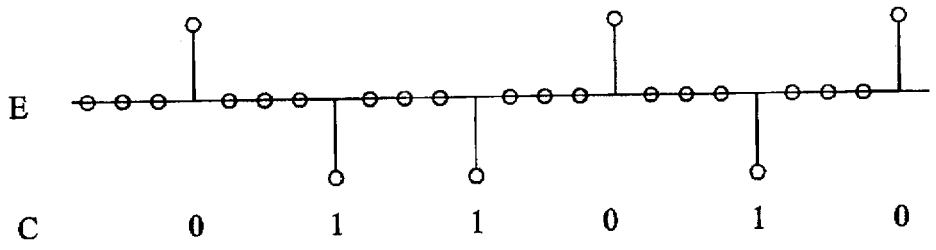
Fig 2 (Prior Art)
FIG. 2, previously described, shows an example of an excitation sequence and of the corresponding code.

Generally, to obtain better results, the location of the first pulse of excitation sequences E is variable. In the example of FIG. 2, this location can be one of the four first locations, which is determined by two further bits transmitted to the decoder and which multiplies the number of excitation vectors to try by four. In this case, for each of the four possible positions, a target vector and an excitation vector are first formed as previously explained. Among the four vectors thus obtained, the one which maximizes the complete criterion m is retained as the approximate optimum excitation vector.

Having thus described at least one illustrative embodiment of the invention, various alterations, modifications, and improvements will readily occur to those skilled in the art. Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A method for determining an excitation vector associated with a frame of a speech signal to be compressed, said vector belonging to a subset associated with a larger set of excitation vectors likely to maximize a criterion, and having as components values 1 and −1 corresponding to a sequence of excitation samples of a linear prediction filter, said criterion being equal to the square of the ratio between, on the one hand, the scalar product of the excitation vector by a target vector formed by samples of the frame submitted to an inverse linear prediction filtering and, on the other hand, the module of the excitation vector submitted to a direct linear prediction filtering, the method including the following steps:

preselecting an excitation vector having as components those with the same signs as the corresponding samples of the target vector, or those with the opposite signs;

if the preselected excitation vector does not belong to the subset, selecting as an excitation vector the vector which maximizes said criterion among the vectors of the subset which are respectively associated with the preselected vector and with the vectors closest to it in the larger set; and using the excitation vector which maximizes said criterion to compress the speech signal.

2. A method according to claim 1, wherein the excitation vectors are associated with excitation codes having bits corresponding to the signs of the components of the excitation vector, an excitation code subset associated with said vector subset being formed by binary values completed by error correction bits, any excitation code being associated with an excitation code of the subset through an error correction function, the method further including the following steps:

forming a group including a preselected code associated with the preselected vector and the codes closest to it, in that each of these closest codes differs from the preselected code by a single bit;

submitting the codes of this group to the error correction function so as to obtain a group of corrected codes belonging to the subset; and selecting as the excitation code, among the corrected codes, the one associated with the vector which maximizes said criterion.

3. A method according to claim 2, wherein the error correction bits are the bits of a Hamming correcting code.

4. A method for determining an excitation vector for compressing a speech signal, the excitation vector being selected from a plurality of excitation vectors that correspond to a respective excitation code, each excitation vector belonging to a respective subset of a plurality of excitation vector subsets that correspond to a respective one of a plurality of excitation code subsets, the method comprising the steps of:

sampling the speech signal;

inverse pitch filtering and inverse linear prediction filtering the sampled speech signal to generate a target vector;

selecting an initial excitation code that minimizes a difference between the target vector and the excitation vector that corresponds to the initial excitation code;

determining excitation code subsets that are close to the initial excitation code; and selecting, from among the excitation vectors belonging to the excitation vector subsets that correspond to the determined excitation code subsets, a preferred excitation vector for compressing the speech signal.

5. The method of claim 4, wherein the step of selecting the preferred excitation vector includes a step of selecting the excitation vector that maximizes a quality of the compressed speech signal.

6. The method of claim 4, wherein the step of selecting the initial excitation code maximizes a scaler product of the target vector and the excitation vector corresponding to the initial excitation code.

7. The method of claim 4, further comprising steps of:

limiting components of the target vector to pulses of the sampled speech signal, the components having a polarity; and retaining only the polarity of the components of the target vector;

wherein the step of selecting the initial excitation code includes a step of selecting the initial excitation code that corresponds to an excitation vector having component values that correspond to one of a same polarity or an opposite polarity as the retained polarity of the components of the target vector.

8. The method of claim 7, wherein each excitation vector has component values having a polarity that is one of a first polarity and a second polarity that is opposite to the first polarity, each excitation code having binary component values that represent the polarity of the component values of the corresponding excitation vector, wherein the step of determining includes steps of:

forming a group of excitation codes that are close to the initial excitation code, the group of excitation codes including the initial excitation code and those excitation codes that differ from the initial excitation code by a single binary component value; and applying an error correcting code to each excitation code of the group of excitation codes to bring each excitation code of the group back to an excitation code of one of the excitation code subsets.

9. The method of claim 8, wherein the error correction code is a Hamming correcting code.

10. The method of claim 8, further comprising a step of:

forming excitation codes that belong to each excitation code subset of the determined excitation code subsets by completing binary component values of each determined excitation code subset with error correction bits;

wherein the binary component values of each excitation code of a respective excitation code subset are associated with the binary component values of the excitation code subset by an error correcting function.

11. The method of claim 10, wherein the error correction bits are bits of a Hamming correcting code.

12. The method of claim 10, wherein the step of selecting the preferred excitation vector includes steps of:

determining a ratio for each excitation vector belonging to the excitation vector subsets that correspond to the determined excitation code subsets, the ratio equaling a square of a scaler product of the target vector and the excitation vector divided by a square of a module of the excitation vector submitted to pitch and linear prediction filtering;

comparing the ratios of each of the excitation vectors; and selecting the excitation vector having a maximum ratio as the preferred excitation vector.

13. The method of claim 4, wherein the step of selecting the preferred excitation vector includes steps of:

determining a ratio for each excitation vector belonging to the excitation vector subsets that correspond to the determined excitation code subsets, the ratio equaling a square of a scaler product of the target vector and the excitation vector divided by a square of a module of the excitation vector submitted to pitch and linear prediction filtering;

comparing the ratios of each of the excitation vectors; and selecting the excitation vector having a maximum ratio as the preferred excitation vector.

14. A CELP encoder comprising:

a filter that receives a speech signal and generates a target vector having components that correspond to pulses in the speech signal;

a sign circuit coupled to the filter that generates an initial excitation code corresponding to the components of the target vector, the initial excitation code having binary components that correspond to a polarity of the pulses in the speech signal;

a corruption circuit coupled to the sign circuit that corrupts the binary components of the initial excitation code to form a corrupted excitation code group, the corrupted excitation code group including the initial excitation code and excitation codes within a single bit of the initial excitation code;

a correcting circuit coupled to the corruption circuit that corrects each excitation code in the corrupted excitation code group to determine excitation code subsets that are closest to each of the excitation codes in the corrupted excitation code group; and a comparison circuit, that determines a preferred excitation vector for compressing the speech signal based upon excitation vectors corresponding to excitation codes within the excitation code subsets.

15. The CELP encoder of claim 14, wherein the filter further receives a pitch of the speech signal and linear prediction coefficients corresponding to the speech signal, the filter having a transfer function that is an inverse of a comb filter having the pitch of the speech signal and an inverse of a linear prediction filter having the linear prediction coefficients of the speech signal.

16. The CELP encoder of claim 15, wherein the initial excitation code maximizes a scaler product of the target vector and an excitation vector corresponding to the initial excitation code.

17. The CELP encoder of claim 16, wherein the correcting circuit corrects each excitation code in the corrupted excitation code group using a Hamming correcting code.

18. The CELP encoder of claim 17, wherein the comparison circuit determines a ratio for each respective excitation vector corresponding to a respective excitation code within the excitation code subsets, the ratio equaling a square of a scaler product of the target vector and the respective excitation vector divided by a square of a module of the respective excitation vector submitted to pitch and linear prediction filtering, the comparison circuit comparing the ratios of each of the respective excitation vectors and selecting the excitation vector having a maximum ratio as the preferred excitation vector.

19. The CELP encoder of claim 15, wherein the correcting circuit corrects each excitation code in the corrupted excitation code group using a Hamming correcting code.

20. The CELP encoder of claim 15, wherein the comparison circuit determines a ratio for each respective excitation vector corresponding to a respective excitation code within the excitation code subsets, the ratio equaling a square of a scaler product of the target vector and the respective excitation vector divided by a square of a module of the respective excitation vector submitted to pitch and linear prediction filtering, the comparison circuit comparing the ratios of each of the respective excitation vectors and selecting the excitation vector having a maximum ratio as the preferred excitation vector.

* * * * *